US011512376B2

(12) United States Patent
Hosoi

(10) Patent No.: US 11,512,376 B2
(45) Date of Patent: Nov. 29, 2022

(54) METHOD FOR MANUFACTURING 7000-SERIES ALUMINUM ALLOY MEMBER

(71) Applicant: Kobe Steel, Ltd., Kobe (JP)

(72) Inventor: Hiroaki Hosoi, Kobe (JP)

(73) Assignee: Kobe Steel, Ltd., Kobe (JP)

( * ) Notice: Subject to any disclaimer, the term of this patent is extended or adjusted under 35 U.S.C. 154(b) by 249 days.

(21) Appl. No.: 16/925,529

(22) Filed: Jul. 10, 2020

(65) Prior Publication Data

US 2021/0079507 A1 Mar. 18, 2021

(30) Foreign Application Priority Data

Jul. 11, 2019 (JP) ..... JP2019-129402

(51) Int. Cl.
*C22F 1/047* (2006.01)

(52) U.S. Cl.
CPC ..... *C22F 1/047* (2013.01)

(58) Field of Classification Search
CPC ..... C22F 1/047
See application file for complete search history.

(56) References Cited

U.S. PATENT DOCUMENTS 9,399,437 B2 * 7/2016 Hashimoto ..... B60R 19/18
2017/0101704 A1 * 4/2017 Bassi ..... B21D 22/022

FOREIGN PATENT DOCUMENTS

JP 2009-114514 A 5/2009
JP 2013-23753 A 2/2013

OTHER PUBLICATIONS

Wang Hui, et al/Trans. Nonferrous Met. Soc. China 22(2012) 1 ►► 7 (Year: 2012).*
Espacenet machine translation of JP2013023753A (Year: 2013).*

* cited by examiner

*Primary Examiner* — Anthony J Zimmer
*Assistant Examiner* — Nazmun Nahar Shams
(74) *Attorney, Agent, or Firm* — Oblon, McClelland, Maier & Neustadt, L.L.P.

(57) ABSTRACT

When a T1-tempered aluminum alloy extrusion is subjected to plastic working and thus formed into a product, crack occurrence is prevented during plastic working, and tensile residual stress of the product is reduced to improve stress corrosion cracking resistance. A T1-tempered 7000-series aluminum alloy extrusion is heated to a temperature range of 150° C. or higher, and then subjected to plastic working within the temperature range, and then cooled, and then subjected to artificial temper aging. An integral value ($F_{140}$) of $(T(t)-140)^2$ is controlled to $5\times10^5$ (° C.$^2$·s) or less in a section of $t_1 \leq t \leq t_2$, where t is time (s) from heating start, T(t) is temperature (° C.) of the extrusion at time t, $t_1$ is time before the extrusion reaches 140° C. in a heating step, and $t_2$ is time before the extrusion reaches 140° C. again in a cooling step.

4 Claims, 4 Drawing Sheets

METHOD FOR MANUFACTURING 7000-SERIES ALUMINUM ALLOY MEMBER

BACKGROUND

The present invention relates to a method for manufacturing a 7000-series aluminum alloy member, and specifically relates to a method for manufacturing a 7000-series aluminum alloy member through plastic working on a T1-tempered aluminum alloy extrusion.

Aluminum alloy has a density of about 2.7 $gcm^{-3}$, about one third as large as steel, and is thus recently increasingly used in a transport field essentially requiring lightweight, specifically an automotive field. Among others, an aluminum alloy extrusion may be advantageously directly formed into an elongated workpiece with a close section having any thickness distribution without additional working and is thus more actively used for auto frame components or energy absorption components. Such frame components include a rocker, a side member, and a pillar. The energy absorption components include a door reinforcement, a bumper reinforcement, and a roof reinforcement.

The weight reduction effect given by replacing auto components made of steel with components produced from aluminum alloy extrusions is heavily dependent on strength (proof stress) of the aluminum alloy. Hence, high-strength aluminum alloy is now actively developed for the auto frame components or the energy absorption components.

The high-strength aluminum alloy typically includes precipitation hardening alloy, such as 6000 series (Al—Mg—Si—(Cu) series) alloy and 7000 series (Al—Zn—Mg—(Cu) series) alloy. In general, the 6000 series aluminum alloy has a 0.2%-proof stress of about 200 to 350 MPa while the 7000 series aluminum alloy has a 0.2%-proof stress of about 300 to 500 MPa after T5, T6, or T7 tempering. In particular, the 7000 series aluminum alloy has high strength and thus promisingly exhibits a high weight reduction effect.

On the other hand, the high-strength 7000 series aluminum alloy may be cracked at a portion constantly subjected to tensile stress under corrosive environment. That is, stress corrosion cracking (SCC) may disadvantageously occur in such an aluminum alloy. Such a stress corrosion crack is susceptible and readily develops, which is therefore strongly desired to be avoided.

The stress corrosion cracking in general tends to occur in a higher strength material, and thus the 7000 series aluminum alloy is not used for auto components in many cases due to the stress corrosion cracking as a bottleneck. The stress corrosion cracking occurs at a portion subjected to tensile stress at or above a threshold while the portion is exposed to corrosive environment. Such tensile stress is often caused by tensile residual stress occurring in a step of plastic working, cutting work, or a heat treatment during manufacturing of the material.

Additional working such as plastic working or cutting work is required to form the aluminum alloy extrusion into an auto component. Plastic working is a process to deform a material by mechanical force into a product having predetermined shape and size, and includes bend forming to change a longitudinal shape of the aluminum alloy extrusion, non-uniform section forming to squash or expand a cross section by a press, and shearing work including punching or cutting by a press.

Tensile residual stress occurs in an aluminum alloy member (member produced from the aluminum alloy extrusion through additional working or heat treatment) due to such additional working (plastic working or cutting work) or heat treatment. The tensile residual stress particularly disadvantageously occurs due to the plastic working. The bend forming, non-uniform section forming, and shearing work are typical examples of the plastic working performed on the aluminum alloy extrusion.

The bend forming, which is performed by various methods, generally causes high tensile residual stress along a longitudinal direction in the bending inside (concave side) and in part of a side surface. The non-uniform section forming causes high residual stress along a sectional circumferential direction of a surface on a concave side of a side that is bending-deformed with the non-uniform section forming. In this way, the bend forming and the non-uniform section forming each basically cause high tensile residual stress in the bending inside. The shearing work often causes tensile residual stress typically in a shearing-deformed part (plastic-deformed portion due to shearing work). The cutting work less often causes high tensile residual stress in a surface.

As a technique to suppress the tensile residual stress occurring in the 7000-series aluminum alloy member, Japanese Patent No. 5671422 describes that a T1-tempered 7000-series aluminum alloy extrusion is subjected to restoring (heat treatment) under a predetermined condition, and then subjected to plastic working at normal temperature, and then subjected to artificial temper aging. The phrase "T1 tempering" refers to a state where an extruded material is subjected to no tempering other than natural temper aging.

Japanese Unexamined Patent Application Publication No. 2009-114514 describes that a 7000-series aluminum alloy extrusion is subjected to solution treatment and hardening, and then subjected to heat treatment of 50 to 100° C.×1 to 30 min, and then heated to 100 to 200° C. and subjected to plastic working (warm working) within such a temperature range and cooled, and then subjected to artificial temper aging.

SUMMARY

According to the technique of Japanese Patent No. 5671422, a T1-tempered 7000-series aluminum alloy extrusion can be subjected to plastic working at normal temperature without crack occurrence, making it possible to reduce tensile residual stress of a product (aluminum alloy member) and improve stress corrosion cracking resistance. However, further improvement in stress corrosion cracking resistance is still required.

According to the technique of Japanese Unexamined Patent Application Publication No. 2009-114514, a W-tempered or T4-tempered aluminum alloy extrusion can be subjected to plastic working without crack occurrence, leading to excellent stress corrosion cracking resistance of a product. However, such a technique is not suitable for the T1-tempered aluminum alloy extrusion that originally allows cost reduction, and requires another heat treatment between the solution treatment and the warm working, resulting in a complicated process.

An object of the invention is, when a T1-tempered aluminum alloy extrusion is subjected to plastic working and thus formed into a product (aluminum alloy member), to prevent crack occurrence during plastic working, and reduce tensile residual stress of the product to improve stress corrosion cracking resistance.

The invention provides a method for manufacturing a 7000-series aluminum alloy member, in which a 7000-series aluminum alloy extrusion is heated from roughly room temperature to a temperature within a predetermined temperature range, and then subjected to plastic working within the temperature range, and then cooled, and then subjected to artificial temper aging, where the 7000-series aluminum alloy extrusion is a T1-tempered material, the temperature range is 150° C. or higher, and an integral value of $(T(t)-140)^2$ is $5\times10^5$ (° C.$^2$·s) or less in a section of $t_1 \le t \le t_2$, where t is time (s) from heating start, T(t) is temperature (° C.) of the extrusion at time t, $t_1$ is time before the extrusion reaches 140° C. in a heating step, and $t_2$ is time before the extrusion reaches 140° C. again in a cooling step.

According to the invention, when a T1-tempered 7000-series aluminum alloy extrusion is subjected to plastic working and thus formed into a product (7000-series aluminum alloy member), it is possible to prevent crack occurrence due to the plastic working, reduce tensile residual stress in the product to improve stress corrosion cracking resistance without sacrificing strength of the product.

According to the invention, the above effects can be achieved by a relatively simple approach: In the steps of heating, plastic working, and cooling, plastic working is performed at 150° C. or higher and the above-described integral value is adjusted to $5\times10^5$ or less (° C.$^2$·s).

In the invention, since the T1-tempered 7000-series aluminum alloy extrusion is used as a material, it is possible to inexpensively manufacture components requiring strength, including energy absorption components such as a door reinforcement, a bumper reinforcement, and a roof reinforcement, and auto frame components such as a rocker, a side member, and a pillar.

DETAILED DESCRIPTION

Figure 1:
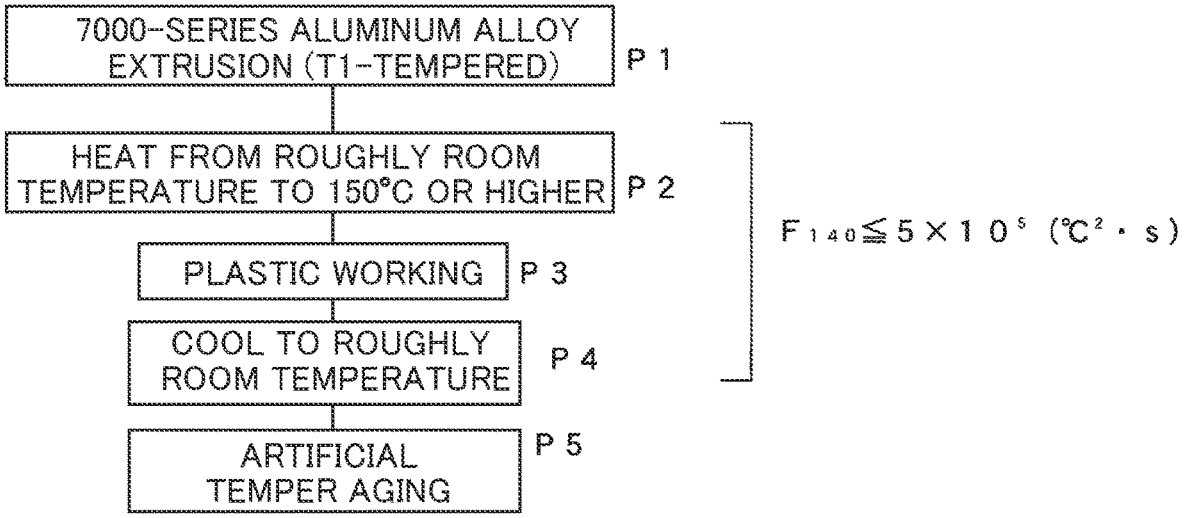
FIG. 1 is a flowchart of a process of the invention.

Hereinafter, a method for manufacturing a 7000-series aluminum alloy member according to the invention is described in more detail. As illustrated in FIG. 1, the manufacturing method includes five steps of manufacturing a T1-tempered 7000-series aluminum alloy extrusion (P1), heating the extrusion from room temperature (r. t.) to 150° C. or higher at a predetermined heating rate (P2), performing plastic working on the extrusion within the above temperature range (P3), cooling the extrusion to the room temperature at a predetermined cooling rate (P4), and temper aging (P5).

T1-tempered 7000-series Aluminum Alloy Extrusion

In the method for manufacturing a 7000-series aluminum alloy member according to the invention, the T1-tempered 7000-series aluminum alloy extrusion is used as a material.

The invention may be applied to 7000-series (Al—Mg—Zn(—Cu) series) aluminum alloy having any composition. However, a preferred composition may contain, in percent by mass, Zn: 3.0 to 9.0, Mg: 0.4 to 2.5, Cu: 0.05 to 2.0, Ti: 0.005 to 0.2, and one or more of Mn: 0.01 to 0.3, Cr: 0.01 to 0.3, and Zr: 0.01 to 0.3, with the remainder consisting of Al and inevitable impurities.

In the invention, the phrase "T1-tempered material" refers to a material subjected to only natural temper aging as tempering after extrusion. In the invention, the phrase "extrusion" refers to an extruded material according to the definition of profiles regulated by JIS H 4100 and an extruded material according to the definition of tubes regulated by JIS H 4080, i.e., includes both a hollow profile and a solid profile.

Examples of the 7000-series aluminum alloy member include energy absorption components such as a door reinforcement, a bumper reinforcement, and a roof reinforcement, and auto frame components such as a rocker, a side member, and a pillar.

Temperature History of Extrusion

Figure 2:
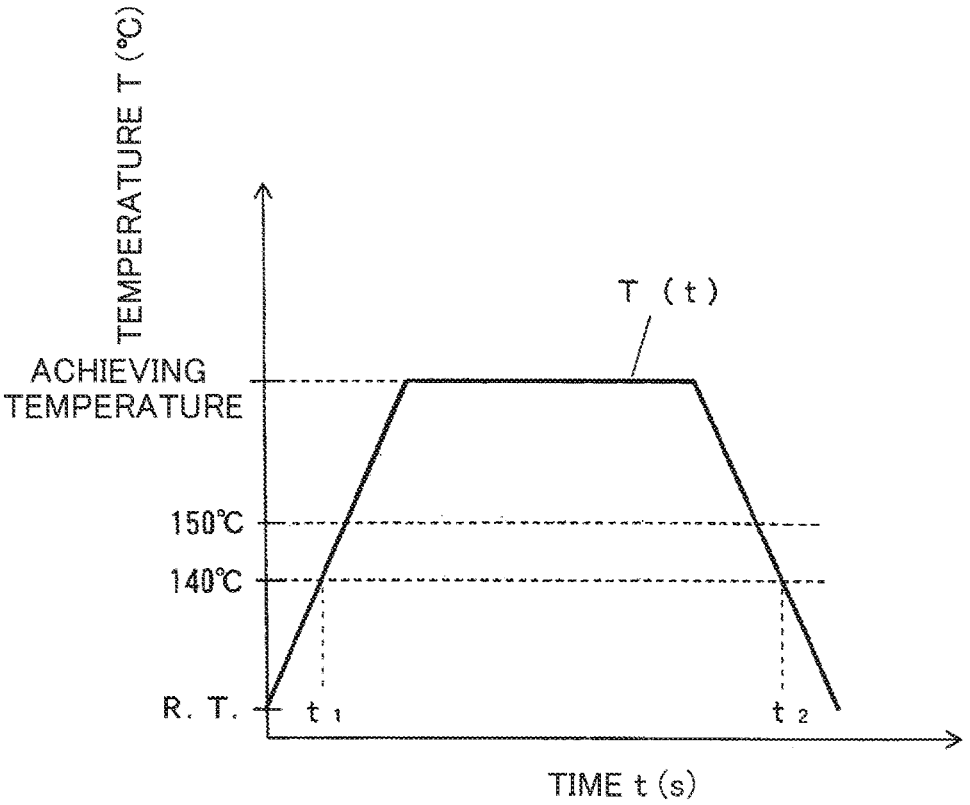
FIG. 2 is a graph explaining a temperature history (relationship between temperature and time) of a 7000-series aluminum alloy extrusion in steps of heating, plastic working, and cooling.

FIG. 2 is a graph illustrating an example of a relationship between temperature and time (temperature history) of an extrusion in the series of steps P2 to P4 (heating, plastic working, and cooling) of FIG. 1. In FIG. 2, the horizontal axis of the orthogonal coordinates represents time t (s) from heating start, and a vertical axis thereof represents temperature T (° C.) of the extrusion at time t.

The extrusion is heated from room temperature (R. T.) at a predetermined heating rate and reaches a temperature of 150° C. or higher (achieving temperature) in the heating step, and then subjected to plastic working at the achieving temperature, and then cooled to the room temperature at a predetermined cooling rate in the cooling step.

The 7000-series aluminum alloy extrusion tends to have lower 0.2%-proof stress (and lower tensile strength) after artificial temper aging as being exposed at a higher temperature for a long time. Such tendency is evident especially when the extrusion is exposed to high temperature more than 140° C. for a long time. In the invention, therefore, when temperature T(t) of the extrusion at time t exceeds the critical temperature (140° C.), the excess temperature (T(t)−140) has been selected as a parameter to express the invention.

In the invention, an integral value $F_{140}$ of $(T(t)-140)^2$ is limited to $5\times10^5$ (° C.$^2$·s) or less in a section of $t_1 \le t \le t_2$, where $t_1$ is time before the extrusion reaches 140° C. in the heating step, and $t_2$ is time before the extrusion reaches 140° C. again in the cooling step. The integral value $F_{140}$ is represented by the numerical expression (1). As described in an example (FIGS. 6 and 7) as described later, the integral value $F_{140}$ is used as a factor to arrange influence of a temperature history on strength of the aluminum alloy extrusion, making it possible to accurately and linearly arrange a relationship between the temperature history and a proof stress ratio ($YS/YS_0$) and a relationship between the temperature history and a tensile strength ratio ($TS/TS_0$).

$$F_{140}=\int_{t_1}^{t_2}(T(t)-140)^2 \le 5\times10^5 \quad \text{Numerical Expression 1}$$

When the integral value $F_{140}$ is $5\times10^{5}$° C.$^2$·s or less, it is possible to produce a high-strength 7000-series aluminum alloy member having a strength as high as the strength of a member given by an existing manufacturing method. In contrast, if the integral value $F_{140}$ exceeds $5\times10^{5}$° C.$^2$·s, 0.2%-proof stress and tensile strength of the 7000-series aluminum alloy member are each apparently reduced after artificial temper aging compared with that by the existing manufacturing method.

The heating rate, the achieving temperature, and the holding time at the achieving temperature in the heating step, and the cooling rate in the cooling step can each be appropriately selected within the condition that the integral value $F_{140}$ is $5\times10^{5}$° C.$^2$·s or less.

The invention mainly covers auto components on the premise of mass production, and thus cycle time (time required for production of one component) is importantly minimized from an economical point of view. In the step of heating or plastic working, since aluminum alloy extrusions are processed one by one by a heater or a press, time for the step of heating or plastic working must be reduced to minimize the cycle time. A typical target of the cycle time in the auto industry is 60 s or less (productivity of 60 pieces or more per hour). To the end, the steps of heating and plastic working are each preferably finished in 60 s or less, and the heating rate is preferably 3° C./s or more, more preferably 5° C./s or more.

In contrast, since the cooling step can be performed in a manner that a plurality of products (aluminum alloy members) are successively processed by a cooler, the cooling rate need not be selected in terms of cycle time. However, since the 0.2%-proof stress (and tensile strength) after artificial temper aging increases with an increase in cooling rate, the cooling rate is preferably 3° C./s or more.

Plastic Working

In the invention, a 7000-series aluminum alloy extrusion is heated from room temperature to a temperature of 150° C. or higher (achieving temperature), and the heated portion is subjected to plastic working (warm working) and then cooled. Although the upper limit of the achieving temperature is not limited as long as the integral value $F_{140}$ can be maintained at $5\times10^{5}$° C.$^2$·s or less, the achieving temperature is actually preferably 300° C. or lower.

The portion of the aluminum alloy extrusion to be heated in the heating step may include at least a portion to be subjected to plastic working, which may be either the whole (the total length region) or a longitudinal part (including, for example, the portion to be subjected to plastic working and its neighborhood) of the aluminum alloy extrusion. The plastic working typically includes bend forming, non-uniform section forming, and shearing work. A die, a jig, and the like to be in contact with the extrusion during plastic working are preferably maintained at or near the achieving temperature in the heating step to prevent temperature decrease during plastic working.

Performing plastic working on the 7000-series aluminum alloy extrusion at 150° C. or higher makes it possible to prevent crack occurrence during plastic working, and reduce tensile residual stress in a product (7000-series aluminum alloy member) due to the plastic working. However, if temperature is lower than 150° C. during plastic working, the effect of preventing crack occurrence is insufficient, and even if no crack occurs, the tensile residual stress in a product due to the plastic working cannot be sufficiently reduced. In light of reducing the tensile residual stress, the temperature is preferably 170° C. or higher, more preferably 200° C. or higher during plastic working. The extrusion is preferably cooled at a cooling rate of 3° C./s or more after plastic working to increase the 0.2%-proof stress (and tensile strength) after artificial temper aging.

Artificial Temper Aging

Artificial temper aging is performed to improve mechanical properties, especially 0.2%-proof stress, of the product (7000-series aluminum alloy member). The artificial temper aging may be performed under any typical temper aging condition for normal 7000-series aluminum alloy, for example, performed at 120 to 160° C. for 6 to 24 hr. Alternatively, a temper aging (overaging) may be performed under a condition of higher temperature and longer time than those of typical temper aging.

First Embodiment

T1-tempered 7000-series aluminum alloy extrusions were heated from room temperature to respective various achieving temperatures and subjected to plastic working (warm working) at the respective achieving temperatures to investigate a temperature condition under which no crack occurs. Such 7000-series aluminum alloy contains, in percent by mass, Mg: 1.4, Zn: 6.5, Cu: 0.15, Zr: 0.15, Cr: 0.03, and Ti: 0.025, with the remainder consisting of Al and inevitable impurities. Each of the extrusions has a rectangular profile with a section about 50 mm high and about 150 mm wide, and includes two hollow parts, a pair of flanges each having a thickness of 2 to 4 mm and a length of about 150 mm, and three webs about 50 mm length arranged at equal spaces while connecting between the pair of flanges. The extrusion is used as a bumper reinforce material, for example.

The extrusion was cut into pieces, each having a certain length, along a direction perpendicular to an extrusion direction to prepare a test sample for temperature history measurement and a plurality of test samples for plastic working.

Figure 3:
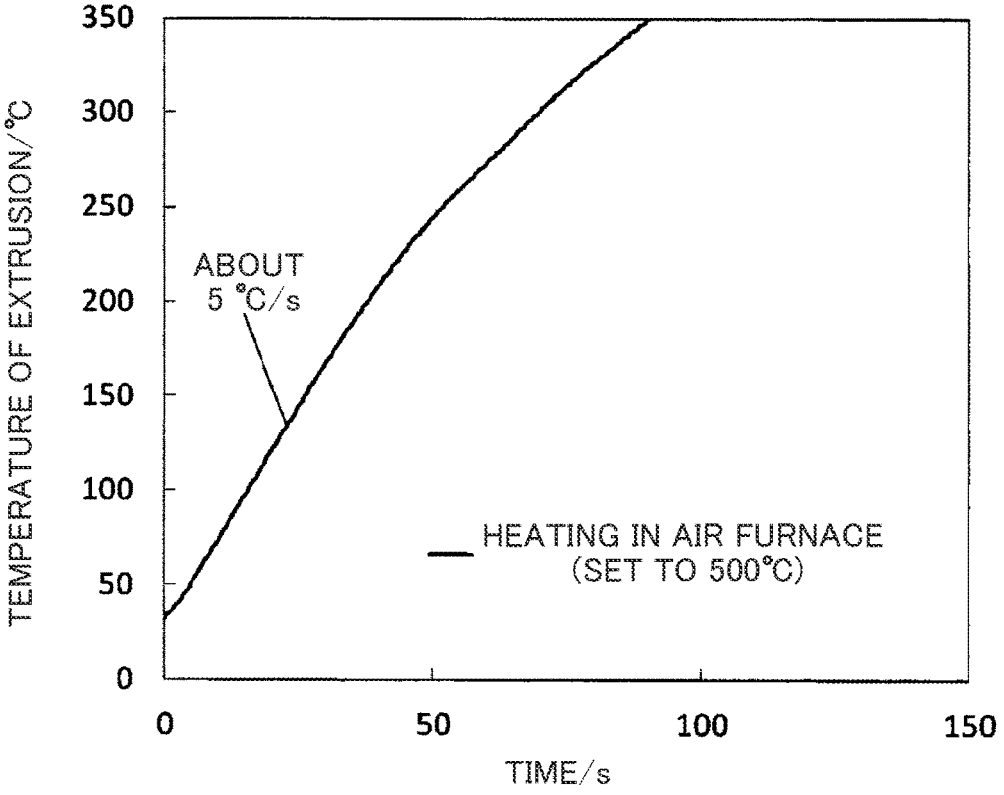
FIG. 3 is a graph illustrating a temperature history of a test sample for temperature history measurement in a first example when the test sample is placed in an air furnace set to 500° C.

The test samples were heated in an air furnace set to 500° C. First, a thermocouple was attached to a web of the test sample for temperature history measurement, and the test sample was loaded in the air furnace to measure a temperature history thereof. FIG. 3 shows results of the measurement. Various periods of time (arrival time) from loading of the test sample into the air furnace to arrival at the various temperatures (achieving temperatures) were obtained based on the temperature history. As illustrated in FIG. 3, heating rate was about 5° C./s up to 350° C.

Subsequently, the test samples for plastic working were loaded into the air furnace one by one. When each test sample reached the predetermined achieving temperature (that is, immediately after the predetermined arrival time has passed), the test sample was taken out from the air furnace and immediately subjected to plastic working (warm working). The plastic working was performed through squashing using a typical press such that the test sample was squashed until its cross-section height was decreased to 20 mm with vertically parallel dies held to the achieving temperature.

Figure 4:
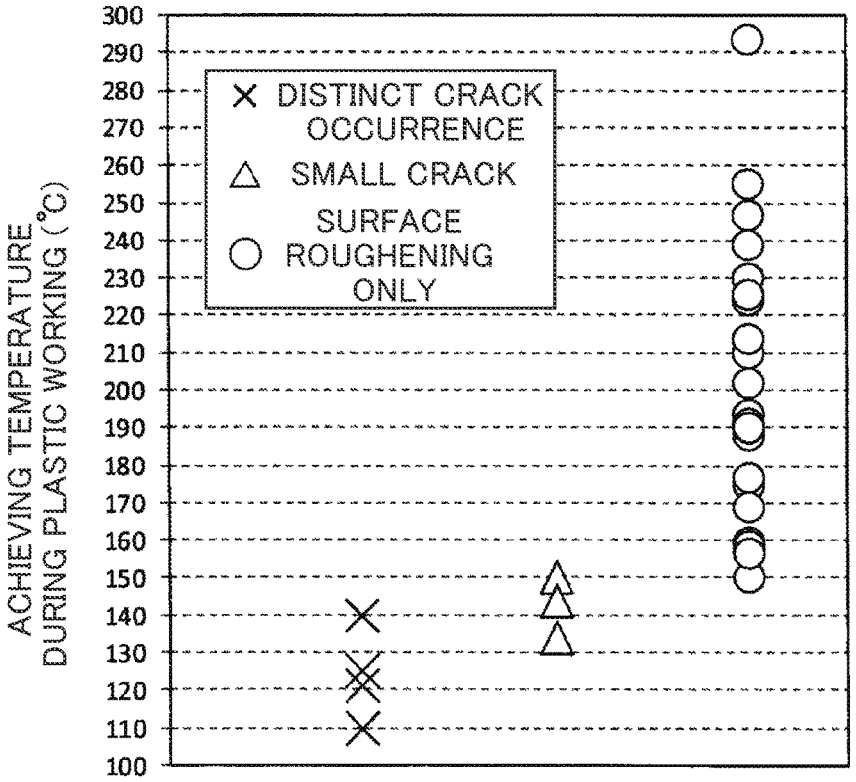
FIG. 4 is a graph illustrating a relationship between temperature and crack occurrence during plastic working of the 7000-series aluminum alloy extrusion in the first example.

In the squashed portion, each web was greatly bent, and a crack parallel to a bending ridge line or surface roughening was found at the bending outside of the web depending on the achieving temperature. FIG. 4 is a graph plotting, as ○, Δ, and x, a relationship between the achieving temperature and quality of appearance of the bending outside of the web. In FIG. 4, x represents distinct crack occurrence, Δ represents occurrence of a small crack, and ○ represents occurrence of only surface roughening.

As seen in FIG. 4, no crack occurs in the plastic working (squashing) at the temperature (achieving temperature) of 150° C. or higher during the plastic working.

Second Embodiment

Figure 5A:
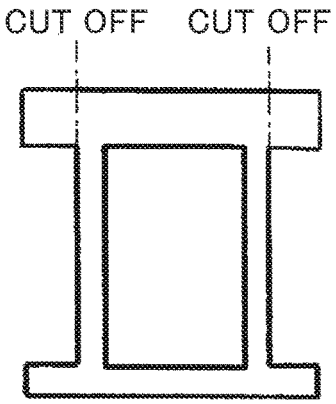
FIG. 5A is a schematic sectional view of a 7000-series aluminum alloy extrusion used in a second example.

T1-tempered 7000-series aluminum alloy extrusions were subjected to plastic working at various temperatures above room temperature to investigate a relationship between plastic working temperature and tensile residual stress. Such 7000-series aluminum alloy has the same composition as that in the first example. Each of the extrusions is used as, for example, a door beam material, includes a pair of flanges parallel to each other and a pair of webs connecting the pair of flanges and perpendicular to the flanges as illustrated in FIG. 5A, and has a height of 35 mm. One of the flanges (thin flange) has a thickness of 2.2 mm and a width of about 34 mm, and the other flange (thick flange) has a thickness of 5.6 mm and a width of 40 mm. Each of the webs has a thickness of 2 mm and a length of 27.2 mm.

The extrusion was cut into pieces, each having a certain length, along a direction perpendicular to an extrusion direction, and projecting portions of the thick flange were cut off to prepare a plurality of test samples.

Each test sample was placed in an air furnace set to 500° C., and when the test sample reached 500° C., the test sample was taken out from the air furnace and cooled while temperature was controlled using a contact thermometer, and when the test sample reached each test temperature (300° C., 250° C., 200° C., 150° C., or 50° C.), the test sample was immediately subjected to plastic working. The plastic working was performed through squashing using a typical press with upper and lower dies held at the test temperature such that the test sample was squashed over a length of 200 mm from its distal end until cross-section height of the test sample was decreased to 25 mm. Two test samples were provided for each test temperature, and the respective test samples were subjected to the squashing in the same way.

The squashed test sample was immediately forced-air-cooled to room temperature.

Each web was greatly bent at the squashed portion.

Figure 5B:
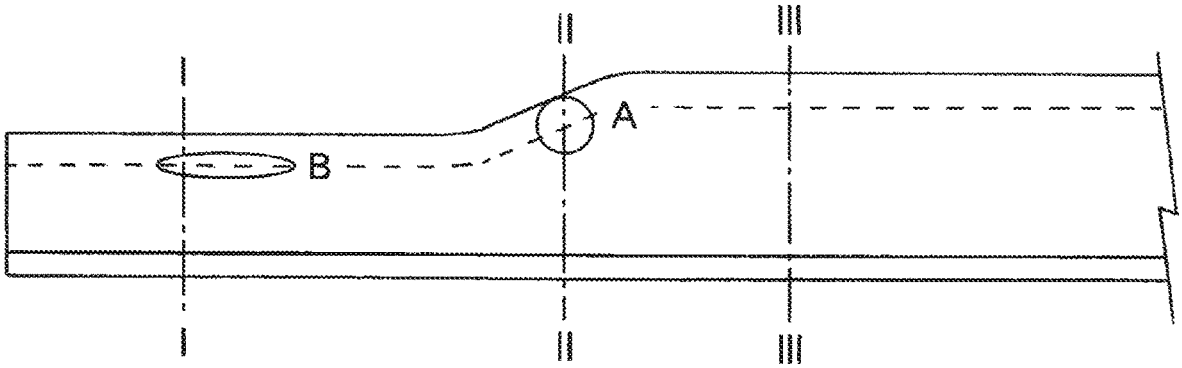
FIG. 5B is a schematic side view of the extrusion that has been plastic-deformed, and FIG. 5C includes sectional views along a line I-I, a line II-II, and a line in FIG. 5B.
Figure 5C:
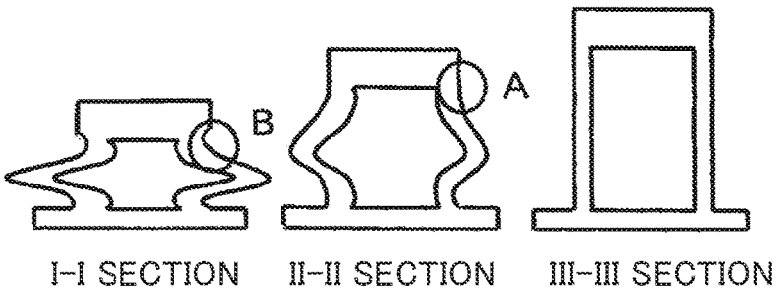

The squashed test sample (before temper aging) was used to measure residual stress at the bending outside of the web due to the squashing using an X-ray stress measurement apparatus MSF-3M (from Rigaku Corporation). The measurement was performed at a position (measurement position A) near the thick flange in an area between a squashed region (having a cross-section height 25 mm) and an unsquashed region (having a cross-section height 35 mm) and at a position (measurement position B) near the thick flange in the squashed region. Table 1 shows a measurement condition and an analysis condition. FIGS. 5B and 5C each illustrate the measuring positions A and B with a mark ○. The measurement position A is in a roughly flat portion, while the measurement portion B is in a concave portion.

Table 2 shows plastic working temperature and measurement results. Table 2 shows each value of the tensile residual stress as an average for the two test samples. In table 2, a numerical value with a minus sign (−) represents a value of compressive residual stress.

TABLE 1

| X-ray Stress Measurement Condition and Analysis Condition | |
|---|---|
| Analysis method: | ISO-inclination method |
| Measurement mode: | φ constant method |

TABLE 1-continued

| X-ray Stress Measurement Condition and Analysis Condition | |
|---|---|
| Counting time: | 2.00 sec |
| Step: | 0.20° |
| Measurement range: | 151.00° to 162.00° |
| φ angle: | 18.0° |
| | 26.3° |
| | 33.1° |
| | 39.2° |
| | 45.0° |
| Tube type: | Cr |
| Characteristic X-rays: | Kα line |
| Stress constant: | −91.10 MPa/° |

TABLE 2

Residual Stress Measurement Result

| Achieving temperature (° C.) | Measurement point A Tensile residual stress (MPa) | Measurement point B Tensile residual stress (MPa) |
|---|---|---|
| 50 | 137.2 ± 31.9 | 86.5 ± 27.9 |
| 150 | 78.8 ± 14.3 | 29.3 ± 6.5 |
| 200 | 13.8 ± 8.1 | 0.9 ± 3.9 |
| 250 | 4.7 ± 2.7 | −12.9 ± 7.3 |
| 300 | −7.3 ± 5.2 | −10.5 ± 2.8 |

As shown in Table 2, when the plastic working temperature is near room temperature, 50° C., high tensile residual stress occurs at each of the measurement positions A and B, but when the plastic working temperature is 150° C. or higher, the tensile residual stress is reduced to 60% or less of that in case of the plastic working temperature of 50° C. When the plastic working temperature exceeded 150° C., the tensile residual stress was conspicuously reduced. It was confirmed that when the plastic working temperature was 150° C. or higher, sufficiently low tensile residual stress occurred in the web while having a value being not greatly changed by the artificial temper aging.

Third Embodiment

JIS 13B test specimens (No. 1 to No. 23) were produced from a flange of a T1-tempered 7000-series aluminum alloy extrusion, which was the same as that in the first example, such that a longitudinal direction of each test specimen was parallel to the extrusion direction. Each test specimen had a thickness of 3 mm. Among them, the test specimens No. 1 to No. 20 were heated from room temperature to respective various achieving temperatures and held for a predetermined time at the achieving temperatures, and then cooled to room temperature at respective various cooling rates, and then subjected to temper aging and subsequent measurement of mechanical properties.

The achieving temperature of each of the test specimens No. 1 to No. 20 was one of 150° C., 200° C., 250° C., and 275° C., and the test specimen was heated to the achieving temperature in an oil bath (150° C., 200° C.) or a niter furnace (250° C., 275° C.). Holding time at the achieving temperature was one of 30 s, 60 s, 90 s, 150 s, and 180 s, and a cooling method was natural cooling or water cooling. Cooling rate from the achieving temperature to 140° C. was about 1° C./s for the natural cooling and about 100° C./s for the water cooling. A temperature history of each test specimen was measured by a type T thermocouple attached to the test specimen with a Kapton (registered tradename) tape.

To compare with existing techniques, the test specimens No. 21 to No. 23 were reheated for solution treatment (held at 480° C. for 3600 s and then cooled by forced wind cooling) and subjected to temper aging under the same condition as for the test specimens No. 1 to No. 20 and subjected to subsequent measurement of mechanical properties.

The test specimens (No. 1 to No. 23) subjected to temper aging were used for a tensile test in accordance with JIS Z 2241(2011) to measure the mechanical properties (0.2%-proof stress, tensile strength, and breaking elongation). Table 3 shows achieving temperature, holding time at the achieving temperature, a cooling method, tensile strength, 0.2%-proof stress, breaking elongation, and a value of $F_{140}$ of each of the test specimens No. 1 to No. 20, and a solution treatment condition (holding temperature, holding time), 0.2%-proof stress, tensile strength, and breaking elongation of each of the test specimens No. 21 to No. 23.

The average 0.2%-proof stress of the test specimens (No. 21 to No. 23) processed by an existing technique was defined as a reference value ($YS_0$), and a ratio ($(YS/YS_0)\times 100$) of the 0.2%-proof stress value (YS) of each of the test specimens (No. 1 to No. 20) to the reference value was obtained. Table 3 also shows such a ratio. The average tensile strength of the test specimens (No. 21 to No. 23) processed by an existing technique was defined as a reference value ($TS_0$), and a ratio ($(TS/TS_0)\times 100$) of the tensile strength value (TS) of each of the test specimens (No. 1 to No. 20) to the reference value was obtained. Table 3 also shows such a ratio.

Figure 6:
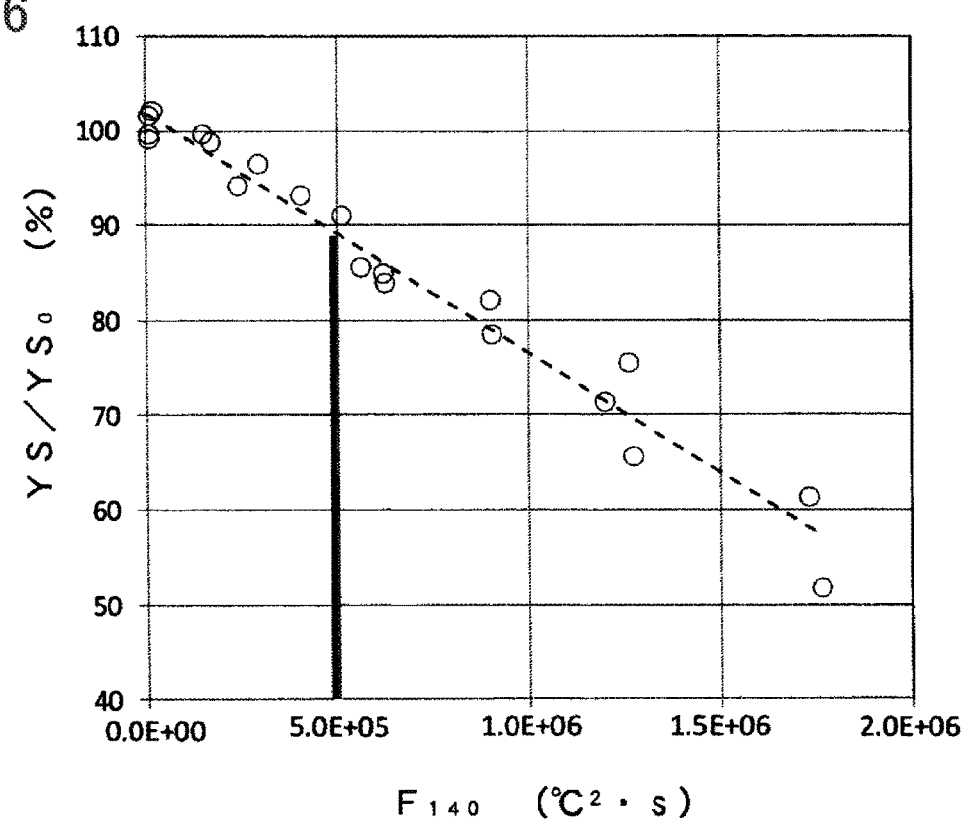
FIG. 6 is a graph illustrating a relationship between an integral value ($F_{140}$) of $(T(t)-140)^2$ in a section of $t_1 \le t \le t_2$ and a ratio (percentage) of 0.2%-proof stress with respect to that in an existing process.
Figure 7:
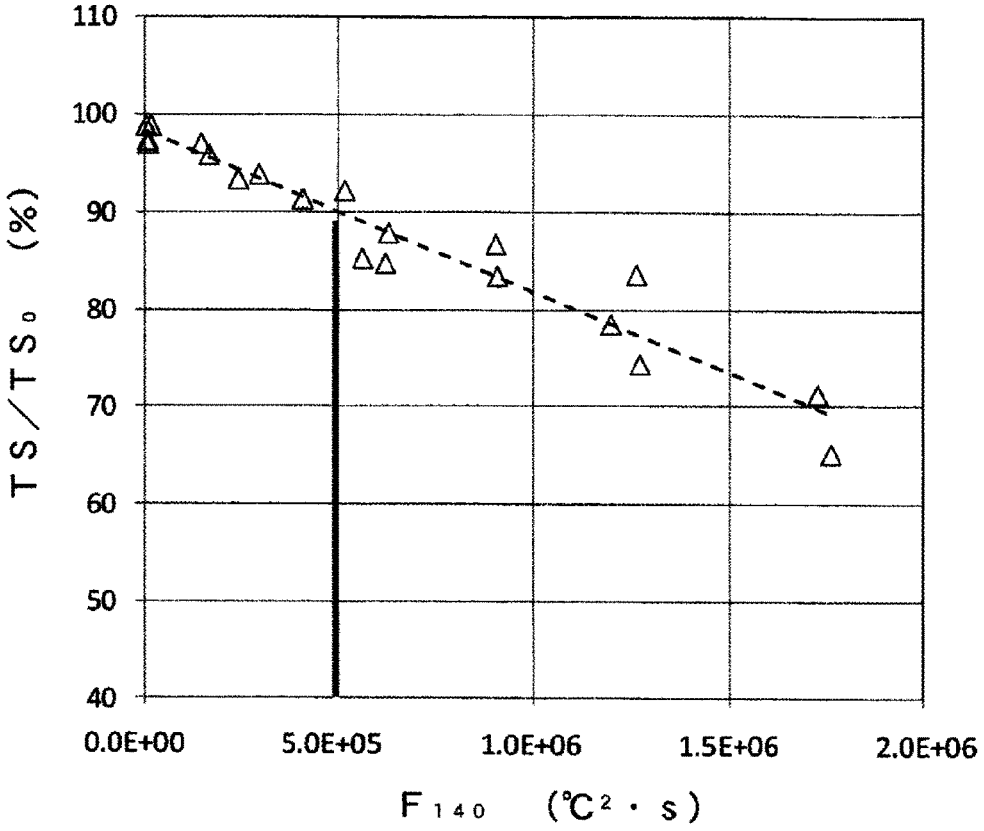
FIG. 7 is a graph illustrating a relationship between an integral value ($F_{140}$) of $(T(t)-140)^2$ in a section of $t_1 \le t \le t_2$ and a ratio (percentage) of tensile strength with respect to that in an existing process.

A relationship between $(YS/YS_0)\times 100$ and $F_{140}$ and a relationship between $(TS/TS_0)\times 100$ and $F_{140}$ obtained based on the data of Table 3 are shown in graphs of FIGS. 6 and 7, respectively.

As illustrated in FIGS. 6 and 7, some of the test specimens No. 1 to No. 20, satisfying $F_{140}\leq 5\times 10^5$ (° C.$^2$·s), have a value of $(YS/YS_0)\times 100$ or $(TS/TS_0)\times 100$ of 90% or more. That is, when $F_{140}\leq 5\times 10^5$ (° C.$^2$·s) is satisfied, change rate (decreasing rate) of 0.2%-proof stress can be controlled to roughly 10% or less with respect to that in the existing technique (No. 21 to No. 23). 0.2%-proof stress is regarded as most important among the mechanical properties for strength members.

As described in the first to third examples, when a T1-tempered 7000-series aluminum alloy extrusion is subjected to plastic working to produce an aluminum alloy member, the temperature of 150° C. or higher during plastic working prevents crack occurrence in plastic working and reduces tensile residual stress. When $F_{140}$ is $5\times 10^5$ (° C.$^2$·s) or less in a temperature history of the 7000-series aluminum alloy extrusion during plastic working, the extrusion may have a strength as high as the strength of an existing material after temper aging.

This application claims the benefits of priority to Japanese Patent Application No. 2019-129402, filed Jul. 11, 2019. The entire contents of the above application are herein incorporated by reference.

What is claimed is:

1. A method for manufacturing a 7000-series aluminum alloy member, the method comprising:

heating a 7000-series aluminum alloy extrusion from about room temperature to a temperature within a predetermined temperature range, and subjecting the 7000-series aluminum alloy extrusion to plastic working within the predetermined temperature range, cooling the 7000-series aluminum alloy extrusion, and

TABLE 3

| | | | | Mechanical properties | | | | | |
|---|---|---|---|---|---|---|---|---|---|
| No. | Achieving temperature (° C.) | Holding time S | Cooling method | Tensile strength (MPa) | 0.2%-proof stress (MPa) | Breaking elongation (%) | $(YS/YS_0)\times 100$ (%) | $(TS/TS_0)\times 100$ (%) | $F_{140}$ (° C. · s) |
| 1 | 150 | 90 | natural cooling | 481 | 444 | 17.4 | 101.6 | 98.8 | $5.59\times 10^3$ |
| 2 | | 90 | water cooling | 474 | 436 | 15.0 | 99.7 | 97.3 | $7.88\times 10^3$ |
| 3 | | 180 | natural cooling | 472 | 433 | 15.6 | 99.2 | 97.0 | $7.30\times 10^3$ |
| 4 | | 180 | water cooling | 480 | 446 | 16.3 | 102.1 | 98.7 | $1.58\times 10^4$ |
| 5 | 200 | 30 | natural cooling | 466 | 431 | 16.1 | 98.7 | 95.9 | $1.68\times 10^5$ |
| 6 | | 30 | water cooling | 472 | 435 | 16.7 | 99.6 | 97.0 | $1.48\times 10^5$ |
| 7 | | 60 | natural cooling | 456 | 421 | 15.6 | 96.5 | 93.8 | $2.95\times 10^5$ |
| 8 | | 60 | water cooling | 454 | 411 | 17.6 | 94.1 | 93.3 | $2.40\times 10^5$ |
| 9 | | 90 | natural cooling | 445 | 407 | 16.0 | 93.1 | 91.4 | $4.08\times 10^5$ |
| 10 | | 150 | natural cooling | 413 | 371 | 13.4 | 85.0 | 84.8 | $6.22\times 10^5$ |
| 11 | | 150 | water cooling | 415 | 374 | 14.0 | 85.7 | 85.2 | $5.64\times 10^5$ |
| 12 | 250 | 30 | natural cooling | 406 | 343 | 12.8 | 78.5 | 83.5 | $9.06\times 10^5$ |
| 13 | | 30 | water cooling | 449 | 398 | 14.7 | 91.0 | 92.3 | $5.15\times 10^5$ |
| 14 | | 60 | natural cooling | 382 | 312 | 14.5 | 71.5 | 78.4 | $1.20\times 10^6$ |
| 15 | | 60 | water cooling | 422 | 359 | 13.3 | 82.2 | 86.7 | $9.02\times 10^5$ |
| 16 | | 90 | natural cooling | 347 | 268 | 15.5 | 61.4 | 71.3 | $1.73\times 10^6$ |
| 17 | | 90 | water cooling | 362 | 287 | 12.7 | 65.7 | 74.3 | $1.27\times 10^6$ |
| 18 | 275 | 30 | water cooling | 428 | 367 | 14.5 | 84.0 | 87.9 | $6.27\times 10^5$ |
| 19 | | 60 | water cooling | 407 | 330 | 12.9 | 75.6 | 83.6 | $1.26\times 10^6$ |
| 20 | | 90 | water cooling | 317 | 226 | 13.1 | 51.7 | 65.1 | $1.76\times 10^6$ |
| 21 | 480 | 3600 | forced wind cooling | 483 | 434 | 17.1 | | | |
| 22 | | | forced wind cooling | 489 | 439 | 16.7 | | | |
| 23 | | | forced wind cooling | 487 | 438 | 16.2 | | | |

(1) YS represents 0.2%-proof stress of each of test specimens No. 1 to No. 20, and $YS_0$ represents average 0.2%-proof stress of test specimens No. 21 to No. 23.

(2) TS represents tensile strength of each of test specimens No. 1 to No. 20, and $TS_0$ represents average tensile strength of test specimens No. 21 to No. 23.

subjecting the 7000-series aluminum alloy extrusion to artificial temper aging, wherein the 7000-series aluminum alloy extrusion is a T1-tempered material, the predetermined temperature range is 150° C. or higher, and an integral value of $(T(t)-140)^2$ is $5\times10^5$ (° C.$^2$·s) or less in a section of $t_1 \leq t \leq t_2$, where t is time (s) from heating start, T(t) is temperature (° C.) of the extrusion at time t, $t_1$ is time before the extrusion reaches 140° C. in the heating, and $t_2$ is time before the extrusion reaches 140° C. again in the cooling.

2. The method according to claim 1, wherein a heating rate is 3°C./s or more.

3. The method according to claim 1, wherein the plastic working is one of non-uniform section forming, bend forming, and shearing work.

4. The method according to claim 1, wherein the 7000-series aluminum alloy member is one of an energy absorption component and an auto frame component.

* * * * *